US009963954B2

(12) United States Patent
Al-Mulhem

(10) Patent No.: US 9,963,954 B2
(45) Date of Patent: May 8, 2018

(54) CALIPER STEERABLE TOOL FOR LATERAL SENSING AND ACCESSING

(71) Applicant: Saudi Arabian Oil Company, Dhahran (SA)

(72) Inventor: Abdulrahman Abdulaziz Al-Mulhem, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 706 days.

(21) Appl. No.: 14/067,008

(22) Filed: Oct. 30, 2013

(65) Prior Publication Data

US 2014/0138084 A1 May 22, 2014

Related U.S. Application Data

(60) Provisional application No. 61/727,215, filed on Nov. 16, 2012.

(51) Int. Cl.

| | |
|---|---|
| ***E21B 41/00*** | (2006.01) |
| ***E21B 47/08*** | (2012.01) |
| ***E21B 17/10*** | (2006.01) |

(52) U.S. Cl.

CPC ..... *E21B 41/0035* (2013.01); *E21B 17/1021* (2013.01); *E21B 47/08* (2013.01)

(58) Field of Classification Search

CPC .. E21B 17/1021; E21B 41/0035; E21B 47/08; E21B 47/09

See application file for complete search history.

(56) References Cited

U.S. PATENT DOCUMENTS 4,219,773 A * 8/1980 Markfelt ..... G01V 3/08 166/66.5
4,673,890 A * 6/1987 Copland ..... E21B 33/124 166/64

(Continued)

FOREIGN PATENT DOCUMENTS

EP 2341211 A1 7/2011
WO 20080068561 A1 6/2008
WO WO2011080292 * 7/2011 ..... E21B 41/00

OTHER PUBLICATIONS

PCT Communication Relating to the Results of the Partial International Searching Authority; dated Nov. 18, 2014; International Application No. PCT/US2013/069816; International File Date: Nov. 13, 2013.

(Continued)

*Primary Examiner* — Shane Bomar
*Assistant Examiner* — Christopher J Sebesta
(74) *Attorney, Agent, or Firm* — Bracewell LLP; Constance G. Rhebergen; Keith R. Derrington

(57) ABSTRACT

Embodiments of a method and apparatus for locating lateral wellbores extending from a main wellbore includes a caliper sensing tool having spring actuated calipers extending radially therefrom. Each of the calipers is connected to a sensor, such as a linear variable displacement sensor, that is used to calculate the radial extension distance of the respective caliper. When the tool is inserted through a wellbore and moves past a lateral wellbore opening, the calipers extend into the lateral wellbore opening. The extension, as well as contact with the surfaces of the lateral wellbore, are used to determine the wellbore depth location and azimuthal direction of the lateral wellbore. A deflectable steering arm is (Continued)

operable to be selectively steered into the lateral opening to facilitate access to the lateral wellbore for logging or intervention purposes.

19 Claims, 5 Drawing Sheets

(56) References Cited

U.S. PATENT DOCUMENTS

| | | | | |
|---|---|---|---|---|
| 5,086,645 | A * | 2/1992 | Deaton | E21B 47/08 417/226 |
| 5,092,056 | A | 3/1992 | Deaton | |
| 5,415,238 | A | 5/1995 | Nice | |
| 5,548,900 | A | 8/1996 | Hunt-Grubbe | |
| 6,012,527 | A * | 1/2000 | Nitis | E21B 7/061 166/313 |
| 6,349,768 | B1 | 2/2002 | Leising | |
| 6,560,889 | B1 | 5/2003 | Lechen | |
| 6,647,637 | B2 | 11/2003 | Lechen | |
| 7,757,782 | B2 | 7/2010 | Tashiro et al. | |
| 7,884,951 | B2 | 2/2011 | Prouvost et al. | |
| 7,954,252 | B2 | 6/2011 | Mather et al. | |
| 8,024,868 | B2 | 9/2011 | Brannigan et al. | |
| 2006/0113111 | A1 * | 6/2006 | Martinez | E21B 47/08 175/45 |
| 2008/0066962 | A1 | 3/2008 | Rolovic et al. | |
| 2008/0135293 | A1 * | 6/2008 | Tashiro | E21B 4/18 175/45 |
| 2009/0271115 | A1 * | 10/2009 | Davis | E21B 47/022 702/6 |
| 2011/0010097 | A1 | 1/2011 | Franquet | |
| 2011/0042072 | A1 | 2/2011 | Villegas et al. | |
| 2011/0048801 | A1 * | 3/2011 | Jacob | E21B 4/18 175/45 |
| 2012/0055711 | A1 * | 3/2012 | Brannigan | E21B 47/08 175/50 |

OTHER PUBLICATIONS

Sondex "Multi Finger Imaging Tool User Guide V1.0", May 2004, 17 pages.

* cited by examiner

CALIPER STEERABLE TOOL FOR LATERAL SENSING AND ACCESSING

CROSS-REFERENCE TO RELATED APPLICATIONS

This application claims priority to and the benefit of U.S. Provisional Patent Application No. 61/727,215 titled "Caliper Steerable Tool for Lateral Sensing and Accessing," filed on Nov. 16, 2012, the disclosure of which is incorporated herein by reference in its entirety.

BACKGROUND OF THE INVENTION

Field of the Invention

The present invention relates in general to wellbore operations and in particular to locating lateral wellbores.

Description of the Related Art

In the field known as well logging, wells are examined using mechanical, electrical and radioactive tools called logging tools. The logging tools are inserted into wellbores that penetrate into reservoirs. The logging tools inserted into wellbores record certain physical measurements that are interpreted to provide a description of petrophysical properties related to the wellbore or the reservoir it penetrates. Well drilling techniques now include multilateral horizontal wells wherein horizontal wells have many branches called laterals. Those laterals branch out from the main bore like tree roots. Generally those branches are drilled using special drilling steering devices. Those laterals are generally not easily accessible by logging tools.

Existing sensing tools used to find laterals in multilateral wells use electronic sensors such as magnetic and ultrasonic sensors. There is a great deal of error associated with those sensors so multiple scanning runs are required, with the resulting signals being fed into an algorithm to provide a statistical interpretation of where the lateral window can be found.

SUMMARY OF THE INVENTION

In embodiments of a lateral finding tool and method of operating the tool, the tool is used to find lateral wellbores that branch off of a main wellbore. Embodiments of lateral finding tools employ a set of spring-actuated calipers connected to linear variable displacement transducers ("LVDT") which provide an electrical signal when the caliper extends radially such that a radial measurement of the wellbore diameter is determinable from the electrical signal. The tool can also be equipped with a steerable arm to steer the bottom hole assembly ("BHA") into laterals to access them for logging and intervention purposes.

In embodiments, calipers extend radially out of the tool providing a measurement of the internal diameter of the wellbore and thus provide a well profile measuring capability. The calipers are distributed radially about the circumference of the tool. In some embodiments, each of 16 calipers are spaced apart by a radial angle of 22.5 degrees such that 16*22.5=360 degrees for a full radial coverage. The LVDTs are calibrated such that they measure the distance the calipers radially extend out from the logging tool body. The radial distance spanned by the calipers is the diameter of the wellbore. As the tool moves past any lateral windows, the LVDTs will read an increase in the wellbore diameter and thus will find the lateral when its window is reached.

Embodiments can also include a magnetic sensor. The magnetic sensor is based on magnetic flux sensing that can sense the presence of well casing. When the tool passes into a wellbore open hole section, this magnetic sensor will, for example, not give any signal so as to indicate the absence of well casing. In such embodiments, when the tool is in the open hole section of the well, there will no magnetic effect due to the absence of metal. Embodiments of the tool can be equipped with a deflection arm, acting like a steering device to help the logging assembly access the lateral.

The tool provides a mechanism to find and access laterals in maximum reservoir contact wells (MRC). In an exemplary embodiment, the tool is equipped with 16 caliper fingers extending radially from the tool. The fingers (calipers) can be spring-actuated and are connected to electronic devices such as LVDT's to provide an indication of the radial extension of the 16 fingers. Each finger with its azimuthal location can provide a precise profile of the well.

In a well completion report, lateral depths are normally provided. Comparing the lateral depths in this report with the measurement provided by embodiments of the tool can confirm the location depth of a lateral. The operator can then selectively activate the steerable arm into the azimuthal direction of the lateral to access it and direct the logging tools into the lateral.

Embodiments of the caliper sensing tool can avoid error resulting from sensing devices such as ultrasonic sensors or pressure sensors because the sensing it employs is purely mechanical based on the fingers extending radially out of the tool. The caliper fingers can be readily calibrated during the function of the tool in the field and before it is inserted into the well under examination.

Embodiments of the lateral finding and accessing tool employ mechanical arms called calipers to measure the internal diameter of a well and any physical changes to its cylindrical shape. In the case of a well having multilateral branches known as laterals, the tool can be used to locate a lateral branching from the main bore. In an embodiment, the tool employs 16 spring-actuated calipers radially extending out of the tool and distributed around the circumference of the tool such that each caliper occupies a radial angle of 22.5 deg. The 16 calipers thus cover the 360 degrees around the cylindrical well. The calipers can connect to LVDT transducers, which are electrical potentiometers that will change resistance when the caliper extends; such that they will provide data from which the extension of each caliper arm is ascertainable. The change in resistance sensed by the LVDT is converted into a radial measurement of the radius of the well. As the tool with those calipers passes by a lateral, an increase in the caliper radial extension will be detected by the LVDTs, thus providing a profile log of the well and its laterals. A plurality of calipers that is a subset of all of the calipers can extend into the opening of the lateral bore. The plurality of calipers that have extended into the lateral bore can indicate the direction the lateral is in. Furthermore, because each of the calipers that extend into the lateral bore may contact a portion of the lateral bore, the profile of that portion of the lateral bore can be determined. The operator then can steer the steerable arm into that direction to allow the BHA to further access the lateral.

Embodiments of a method for detecting lateral bores from a main wellbore of a well include the steps of providing a caliper tool into the main wellbore, the caliper tool including a head having a first end, a second end, and a plurality of calipers extending radially therefrom; moving the caliper tool axially through the wellbore on a deployment member, the deployment member being connected to the first end of the head; detecting an inner diameter surface of the wellbore with the calipers by ascertaining the distance that each of the calipers extend from the head; detecting a lateral opening in the wellbore with at least one of the plurality calipers, the lateral opening being an opening of a lateral bore branching off of the wellbore; and determining the distance from the surface of the earth to the lateral opening.

In embodiments, each of the calipers is operatively connected to a measurement device, and the method further includes the step of ascertaining the radial distance by which each of the calipers extends from the head of the caliper tool with the measurement devices. In embodiments, each one of the plurality of calipers comprises a pair of segments, and each segment of the pair of segments includes a radially-inner end pivotally coupled to the head of the caliper tool and radially-outer end coupled to a flexible joint defined between the pair of segments, and the step of ascertaining the radial distance by which each one of the plurality of calipers extends from the head of the caliper tool comprises detecting a configuration of at least one of the radially-inner ends of the pair of segments with respect to the head of the caliper tool. In embodiments, the plurality of measurement devices comprises a plurality of linear position sensors disposed axially along the head of the caliper tool such that each linear position sensor is operable to detect an axial position of at least one of the radially-inner ends of the pair of segments along the head of the caliper tool, and the step of ascertaining the radial distance by which each one of the plurality of calipers extends from the head of the caliper tool comprises calculating the radial distance with the axial position detected by the respective linear position sensor. In embodiments, the linear position sensors can comprise linear variable displacement transducers.

In embodiments, each of the plurality of calipers can be biased to a radially outward position, and the step of detecting the lateral opening in the main wellbore includes detecting a movement of at least one of the plurality of calipers from a radially inward position toward the radially outward position as the at least one of the plurality of calipers extends into the lateral opening. In embodiments, the step of detecting the lateral opening in the main wellbore includes detecting an initial contact of the at least one of the plurality of calipers that extends into the lateral opening with a surface of the lateral bore and subsequently detecting at least one of the plurality of calipers that extends into the lateral opening is free of contact with the surface of the lateral bore. In embodiments, the method further includes the step of determining the direction of the lateral bore, relative to the main wellbore, based on the radial or circumferential position of at least one of the plurality calipers that extends into the lateral opening.

In embodiments, the method includes the steps of advancing the caliper tool past the lateral opening and determining a profile of the lateral bore from movements of at least one of the plurality of calipers as the caliper tool advances past the lateral opening. In embodiments each of the plurality of calipers extends from the head a radial distance greater than a radius of the main wellbore when in an unconstrained state. In embodiments, the method includes the step of creating a profile log of the main wellbore and the lateral bore. In embodiments, the caliper tool further includes a centralizer operable to maintain the caliper tool centered in the main wellbore, and the step of detecting an inner diameter surface of the main wellbore includes employing the centralizer to maintain the caliper tool centered in the wellbore so that each of the plurality of calipers extends radially from the head substantially no more than the rest of the plurality of calipers.

In embodiments, the caliper tool includes a steering arm connected to the second end of the head and selectively operable to be angled relative to head, and the method further includes the steps of positioning the caliper tool so that an end of the steering arm is located concentrically with the lateral opening and angling the steering arm in the direction of the lateral opening. In embodiments, the method includes the step of inserting the caliper tool into the lateral opening by axially advancing the deployment member through the main wellbore.

In embodiments, the caliper tool further includes a magnetic sensor, and the method further includes the step of detecting, with the magnetic sensor, the presence of wellbore casing. In embodiments, the method includes the steps of advancing the deployment member through the main wellbore until the magnetic sensor is disposed axially beyond an end of the wellbore casing, detecting, with the magnetic sensor, the absence the wellbore casing, and determining the distance from the surface of the earth to the end of the wellbore casing.

Embodiments of an apparatus for detecting lateral wellbores include a tool body having a first end and a second end; a plurality of calipers extending radially from an outer diameter of the tool body, each of the plurality of calipers including a first segment having a radially-inner end with a fixed radial position with respect to the outer diameter of the tool body and a radially-outer end operable to move in a radial direction with respect to the outer diameter of the tool body, a second segment having an axially-movable radially-inner end with a fixed radial position with respect to the outer diameter of the tool body and a radially-outer end operable to move in a radial direction with respect to the outer diameter of the tool body, and a flexible joint coupling the radially-outer end of the first segment to the radially-outer end of the second segment such that the flexible joint is movable from a radially outward position to a radially inward position with respect to the outer diameter of the tool body in response to axial movement of the of the axially-movable radially-inner end of the second segment. The flexible joint defines a radially outermost portion of the respective caliper. The apparatus also includes a biasing member operatively coupled to the flexible joint of each of the calipers to bias the flexible joint to the radially outward position; at least one sensor operatively coupled to the axially-movable radially-inner end of the second segment of each of the calipers that is operable to sense the axial position of the axially-movable radially-inner end of the second segment of each of the calipers relative to the tool body; a processor operably connected to the at least one sensor and operable to calculate a radial extension distance of each of the plurality of calipers in response to a data signal received from each of the sensors; a steering arm operably connected to the first end of the tool body and a connector operable to couple the second end of the tool body to an insertion member.

In embodiments, the plurality of calipers comprises at least 16 calipers. In embodiments, the apparatus further includes a centralizer that is operable to radially center the tool body in a wellbore. In some embodiments, the steering arm includes a tip at one end and a positioner at another end, the positioner being operable to change the angle of the steering arm relative to the head along at least two axes.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above can be had by reference to the embodiments thereof that are illustrated in the drawings that form a part of this specification. It is to be noted, however, that the appended drawings illustrate some embodiments of the invention and are, therefore, not to be considered limiting of the invention's scope, for the invention can admit to other equally effective embodiments.

DETAILED DESCRIPTION OF THE INVENTION

Figure 1:
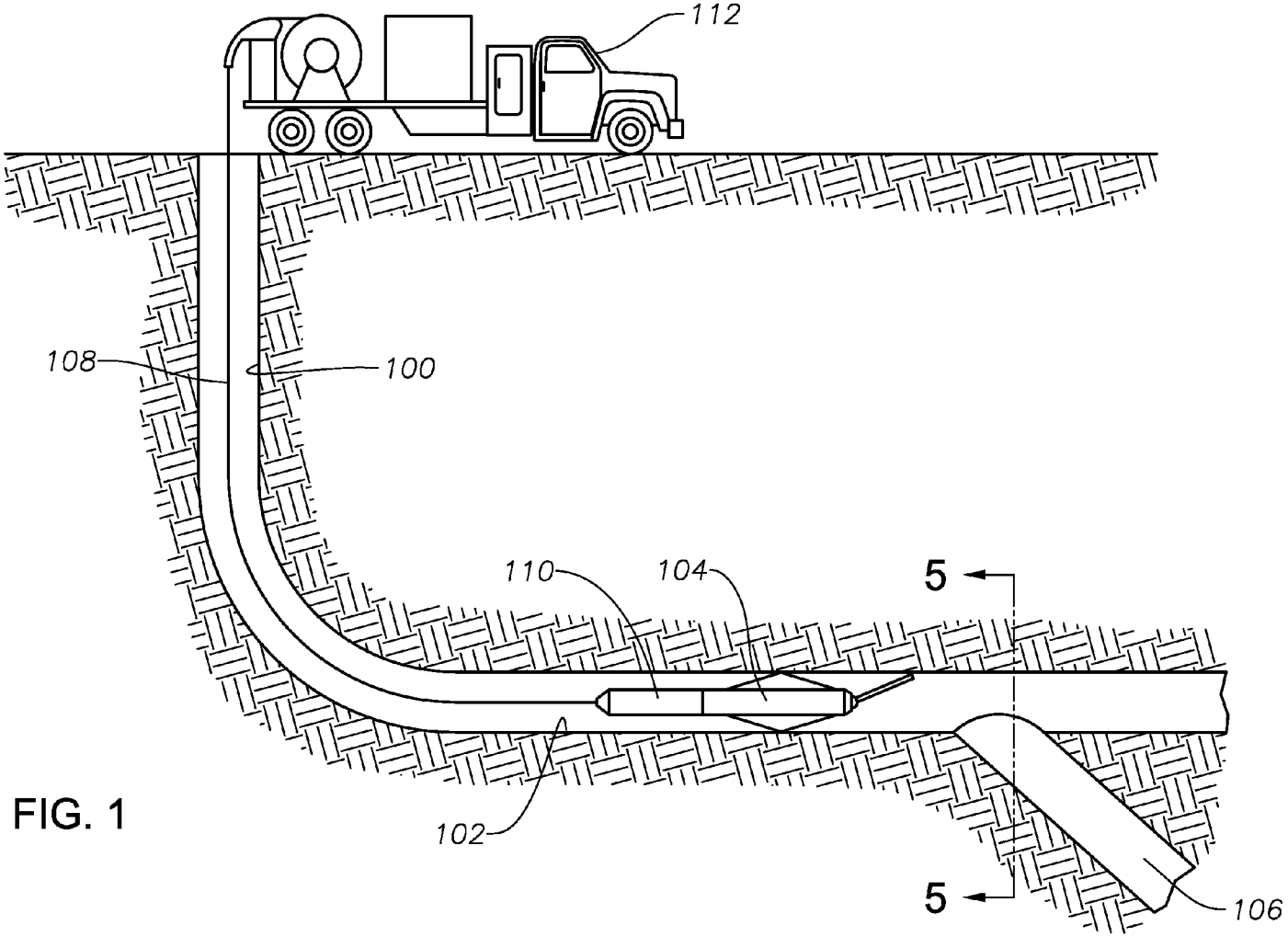
FIG. 1 is a side sectional environmental view of a wellbore with an embodiment of a sensing tool in a wellbore.

FIG. 1 shows wellbore 100, which includes a horizontal wellbore 102. Sensing tool 104 is inserted or deployed into wellbore 102, and can locate lateral branches of the wellbore such as lateral 106. While horizontal wellbore 102 and lateral 106 are shown for descriptive purposes, sensing tool 104 can be used in other types of deviated wells and can be used to detect other types of branch wellbores that extend from a wellbore. Tool 104 can be inserted or deployed into wellbore 100 by a variety of techniques, including, for example, on tubing 108. One or more other tools 110 can be connected to tubing 108 and tool 104, the one or more tools 110 and tool 104 defining a bottom hole assembly ("BHA"). Tool 110 can include, for example, a packer deployment tool for sealing off a lateral wellbore. Tool 110 can include, for example, a deviation survey sub. Truck 112 is shown deploying tubing 108, but, as one of skill in the art will appreciate, other techniques can be used to deploy tool 104.

Figure 2:
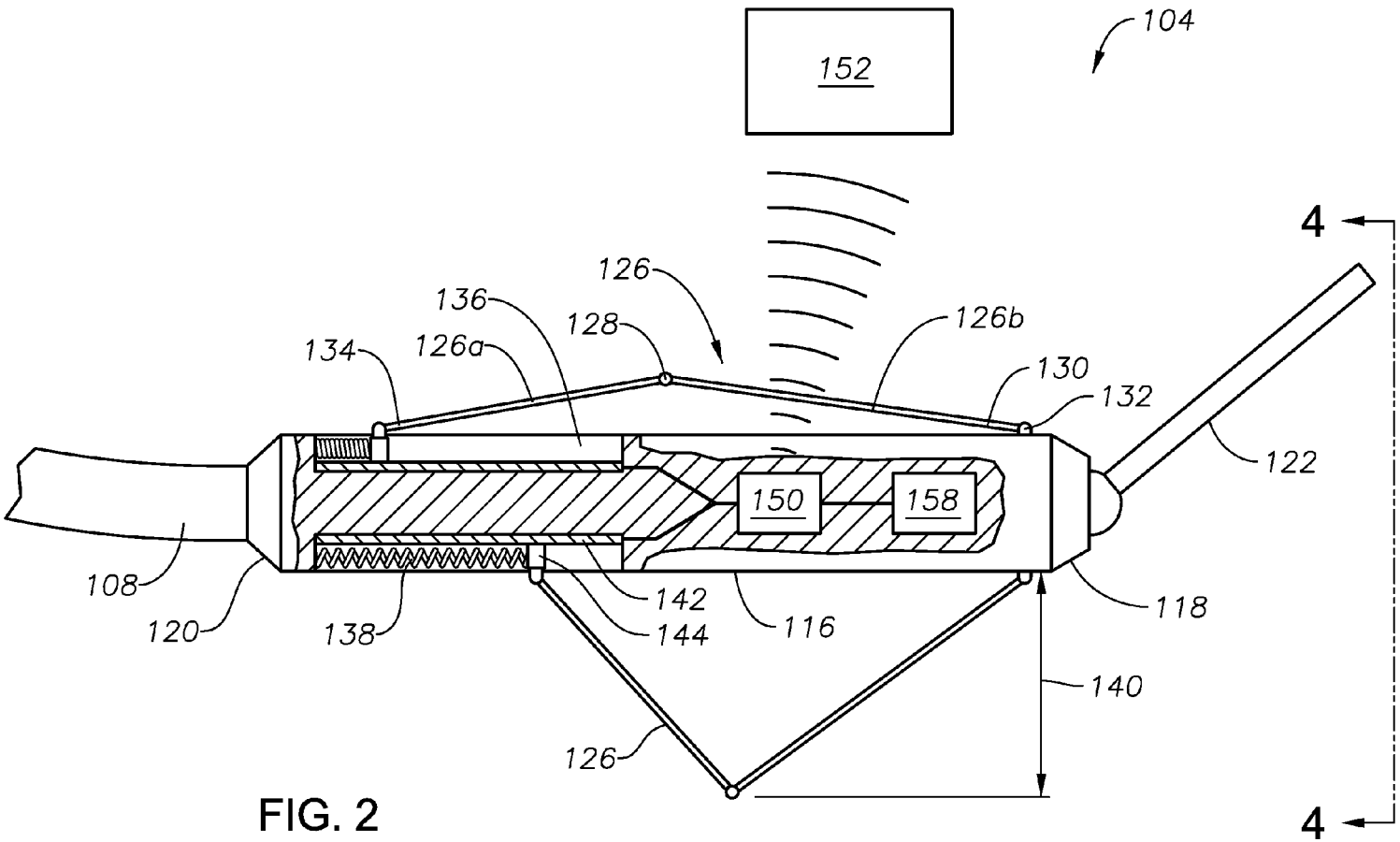
FIG. 2 is a sectional side view block diagram of the sensing tool of FIG. 1.
Figure 3:
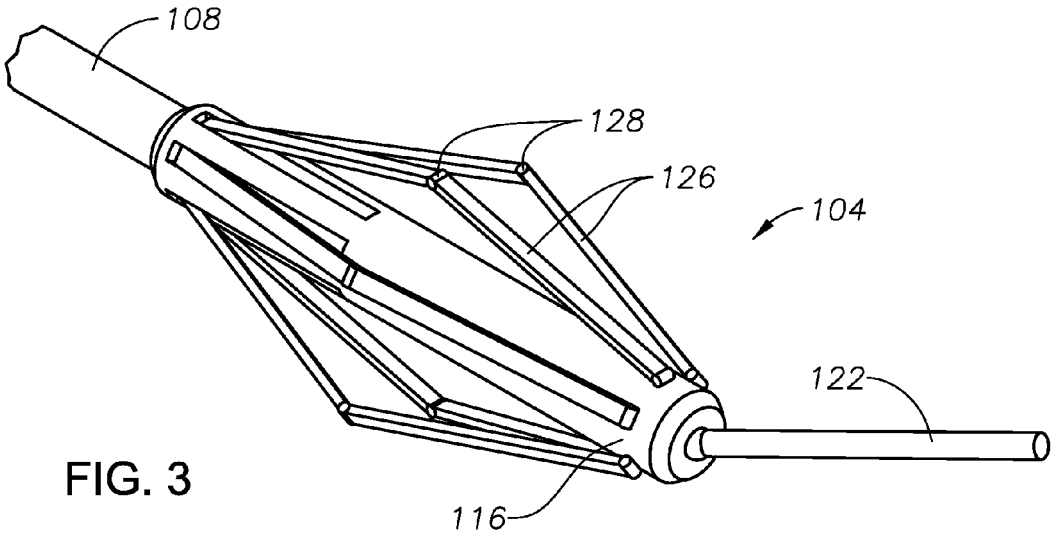
FIG. 3 is a perspective view of the sensing tool of FIG. 1.

FIGS. 2 and 3 show an embodiment of sensing tool 104. Sensing tool 104 includes a tool body 116 having a front end 118 and a back end 120. Steering arm 122 is connected to body 116 at front end 118. A deployment member, such as tubing 108, is connected to body 116 at back end 120. The deployment member can be any device suitable for running sensing tool 104 into the wellbore. As one of ordinary skill will understand, the deployment member can be, for example, tubing, a drill string or running string, or a cable. A plurality of calipers 126 extend radially from tool body 116. Calipers 126 include two or more segments 126*a* and 126*b* that are connected by flexible joint 128. Flexible joint 128 can include hinge or a spring connected to a radially-outer end of each of segment 126*a* and 126*b*. In embodiments, each caliper 126 is a single, monolithic member that can flex at flexible joint 128.

Radially-inner end 130 of segment 126*b* is connected to body 116 at pivot joint 132. Pivot joint 132 is radially constrained such that radially-inner end 130 has a fixed radial position with respect to body 116. Radially-inner end 134 of segment 126*a* is connected to slide connector 136. Slide connector 136 radially constrains radially-inner end 134 of segment 126*a* with respect to body 116 and allows radially-inner end 134 of segment 126*a* to slide axially along a portion of body 116. Slide connector 136 can include, for example, a sleeve that slides along a shaft, a bearing that slides in a track, or another connection that provides for linear movement of radially-inner end 134 relative to body 116. In embodiments, slide connector 136 includes a pivot point that allows radially-inner end 134 of segment 126*a* to pivot relative to body 116. Either or both of pivot joint 132 and slide connector 136 hold caliper 126 so that flexible joint 128 is movable between a radially outward position to a radially inward position with respect to an outer diameter of body 116 in response to axial movement of radially-inner end 134 of segment 126*a*. Conversely, radially-inner end 134 of segment 126*a* is axially movable in response to radial movement flexible joint 128. Flexible joint 128 can move in and out, radially, relative to body 116, and defines a radially outermost portion of caliper 126 regardless of the axial position of radially-inner end 134 of segment 126*a*. The pivot joint 132 and slide connector 136 prevent caliper 126 from rotating circumferentially relative to body 116. Slide connector 136 can include a biasing member such as spring 138 to urge radially-inner end 134 axially toward radially-inner end 130, and thereby urge flexible joint 128 to a radially outward position with respect to body 116. Other biasing configurations can be employed such as, for example, a spring (not shown) at flexible joint 128 that draws segments 126*a* and 126*b* together, or a spring at radially-inner end 130 that urges segment 126*b* radially away from body 116. Any of these configurations cause caliper 126 to be biased toward a configuration of maximum extension when in an unrestrained state.

By sliding along body 116 with slide connector 136, radially-inner end 134 of caliper 126 moves closer to radially-inner end 130. As the two radially-inner ends 134, 130 move closer to each other, flexible joint 128 moves radially outward from body 116. When the two radially-inner ends 134, 130 of caliper 126 move axially apart from each other, flexible joint 128 moves radially inward toward body 116. The extension distance 140 of caliper 126, from body 116 is thus variable and is defined as the radial distance from body 116 to the tip of flexible joint 128. Extension distance 140 is ascertainable by the length of each segment 126*a*, 126*b* of caliper 126 and by the axial travel distance of slide connector 136 as described in greater detail below.

Figure 4:
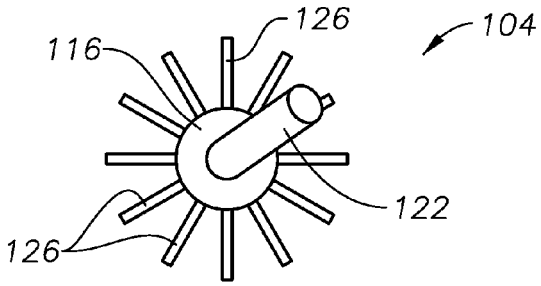
FIG. 4 is an end view of the sensing tool of FIG. 2 taken along the 4-4 line.

As best shown in FIGS. 3 and 4, a plurality of calipers 126 are spaced apart around the circumference of sensing tool 104. In embodiments, 16 calipers 126 are evenly spaced apart around the circumference of sensing tool 104, such that each caliper 126 occupies a radial angle of 22.5 degrees. More or fewer calipers 126 can be used, although using fewer calipers can result in a degradation of the quality of the profile image determined by the sensing tool 104.

Referring back to FIG. 2, sensing tool 104 includes position sensors 142 for determining the axial location of radially-inner end 134 relative to body 116. Position sensors 142 are linear position sensors disposed axially along body 116. By determining the axial location of radially-inner end 134 of a particular caliper 126, the extension distance 140 can be determined for that particular caliper 126. For example, in embodiments wherein segments 126*a* and 126*b* are substantially rigid with a fixed length, extension distance 140 is readily ascertainable by calculation. Extension distance 140 represents a height of a triangle with a base formed by a portion of body 116 disposed axially between pivot joint 132 and shuttle 144, and two sides of the triangle are formed by segments 126*a* and 126*b*. With the position of the shuttle 144, and thus the position of radially-inner end 134 coupled thereto, determinable by position sensor 142, the length of the base of the triangle is known and can be employed together with the known lengths of the sides (lengths of segments 126*a* and 126*b*) to calculate the height or extension distance 140 as will be appreciated by those skilled in the art.

Calculating extension distance 140 in this manner permits position sensors 142 to be housed within slots defined in body 116 rather than being disposed at flexible joint 128 or at another exposed location such as pivot joint 132, for example. Sensors 142 and associated wiring, power sources (not shown), etc. are thus relatively protected from the wellbore environment. Position sensors 142 can include, for example, a linear variable displacement transducer ("LVDT"). An LVDT is an electrical potentiometer that will change resistance based on the position of a member that moves within, or adjacent to, the LVTD. In the embodiment shown, at least a portion of shuttle 144 moves within sensor 142. As caliper 126 moves from the inward position to the extended position, shuttle 144 moves through sensor 142, changing the resistance of sensor 142. A signal from sensor 142, which reflects the position of shuttle 144 within sensor 142, is sent to computer 150. As one of skill in the art will appreciate, data signals from each caliper 126 can be analog or can be converted to discrete digital signals. Computer 150 can include one or more of a computer, a processor or microprocessor, a memory storage unit, and a program product stored in a tangible medium.

In other embodiments (not shown) alternate types of sensors may be employed to detect a configuration of radially-inner end 134 of segment 126*a* or radially-inner end 130 of segment 126*b* to ascertain extension distance 140. For example, an angle that the radially-inner ends 130, 134 define with respect to body 116 may be sensed by appropriate sensors housed within body 116.

In the embodiment depicted in FIG. 2, computer 150 receives data from each of the plurality of calipers 126 on sensing tool 104, and can determine the extension distance of each caliper 126 based on the data. By combining that position data, computer 150 can determine the shape of the wellbore, such as horizontal wellbore 102, at a given axial position. As sensing tool 104 is moved through the wellbore, each caliper 126 sends data signals to computer 150. The data signals, over time, is called a trace. Computer 150 can use the trace from each caliper 126 to determine the shape of wellbore 150 over the axial distance traveled by sensing tool 104. Computer 150 can be in data communication with display 152 by, for example, cables, wireless data transfer, or a combination thereof. Display 152, which can be a monitor having a screen, can be located on the surface of the earth for presenting data regarding the wellbore shape to an operator.

Referring to FIGS. 2 and 3, steering arm 122 extends from front end 118 of body 116. Steering arm 122 can be used to deflect sensing tool 104 into a lateral wellbore. Steering arm 122 can be selectively angled relative to the axis of body 116. In embodiments, steering arm 122 can be selectively rotated about the axis of body 116. By combining a selective angle with rotation, steering arm 122 can be rotated and angled to point in a particular direction offset from the axis of body 116. Other techniques can be used to selectively point steering arm 122 in a particular direction relative to the axis of body 116.

The length of steering arm 122 can be greater than the radius of wellbore 100, or at least the portion of wellbore 100 in which sensing tool 104 is expected to need to enter a lateral wellbore 106. The length of steering arm 122 can be greater than the diameter of wellbore 100, or at least the portion of wellbore 100 in which sensing tool 104 is expected to need to enter a lateral wellbore 106.

Embodiments can also include a magnetic sensor 158. The magnetic sensor 158 can be a magnetic flux sensor that can sense the presence or absence of wellbore casing. When the tool 104 passes into a wellbore open hole section, wherein no casing is present, magnetic sensor 158 will, for example, not give any signal so as to indicate the absence of well casing. In such embodiments, when the tool 104 is in the open hole section of the well, there will no magnetic effect due to the absence of metal. The magnetic sensor 158 may be employed to determine a distance from the surface of the earth to an end of the wellbore casing. By detecting the wellbore casing with magnetic sensor 158, and then advancing tubing 108 or other deployment member until magnetic sensor is disposed axially beyond an end of the wellbore casing, the point at which magnetic sensor 158 detects the absence the wellbore casing can be noted, and the distance from the surface of the earth to the end of the casing can be determined.

Figure 5:
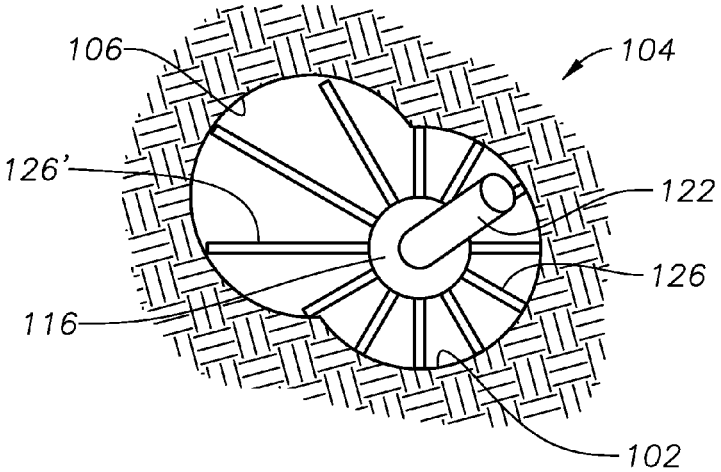
FIG. 5 is a sectional end view of the intersection of the horizontal wellbore and the lateral wellbore with the sensing tool positioned therein, taken along the 5-5 line of FIG. 1.

In embodiments of the caliper sensor, the tool will provide an immediate and affirmative indication of the lateral depth location, length and angle relative to well azimuth. FIG. 5 shows tool 104 at the intersection of horizontal wellbore 102 and lateral 106. Calipers 126 extend radially from body 116, and are restrained by the inner diameter surfaces of horizontal wellbore 102. Some of the calipers 126, identified as calipers 126', extend through the opening through the sidewall of horizontal wellbore 102, into lateral 106. As shown in FIG. 5, calipers 126 have an extension distance 140 (FIG. 2) that is greater than the distance from body 116, when body 116 is generally centered in horizontal wellbore 102, to an inner diameter surface of lateral 106. Because there are multiple calipers 126' in contact with the inner diameter surface of lateral 106, a profile of that portion of lateral 106 can be determined. The trace of each caliper 126 can indicate the location and direction of a lateral 106. Indeed, sensing tool 104 can determine the angle and radial location at which lateral 106 is drilled, relative to the main horizontal wellbore 102, as well as the radial location of the lateral opening within the wellbore.

Figure 6:
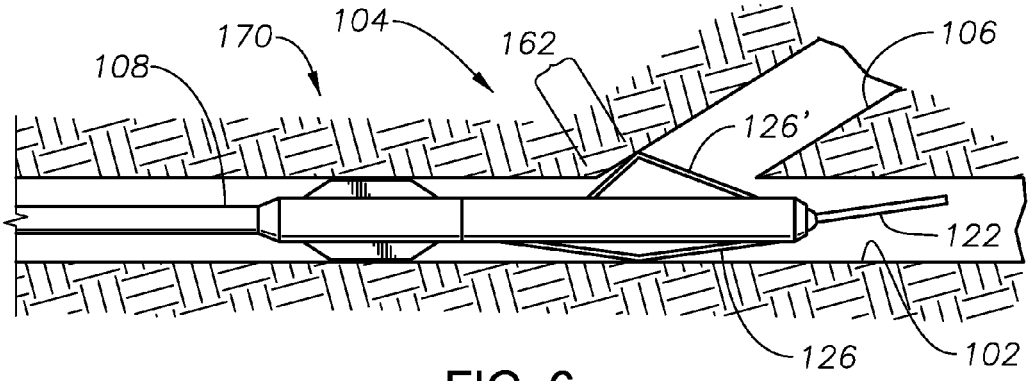
FIG. 6 is a sectional top view of the sensing tool of FIG. 1, showing a caliper in contact with the lateral wellbore.
Figure 7:
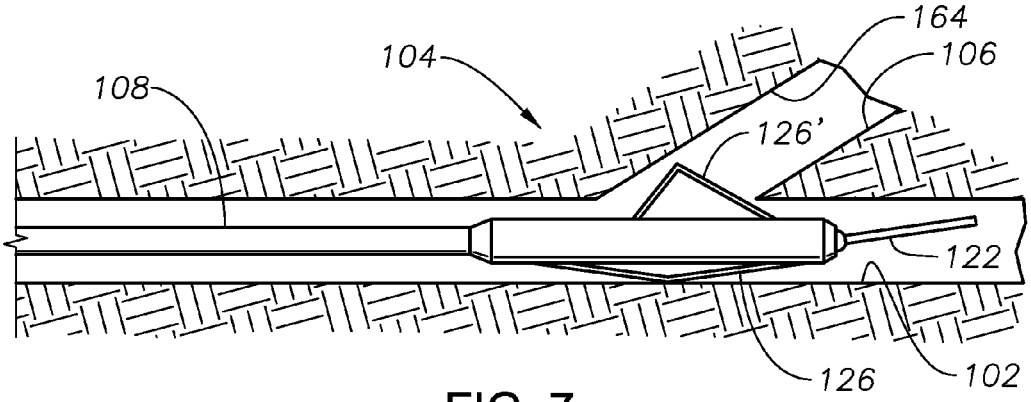
FIG. 7 is a sectional top view of the sensing tool of FIG. 1, showing the caliper after moving out of contact with the lateral wellbore.

FIGS. 6 and 7 show a top view of sensing tool 104 moving past an intersection between lateral 106 and horizontal wellbore 102. As sensing tool 104 moves through horizontal wellbore 102, calipers 126' are in contact with the contacted portion 162 of the inner diameter surface of lateral 106. FIG. 7 shows sensing tool 104 in a position wherein the distance from body 116 to a portion 164 of lateral 106 is greater than the extension distance 140 of calipers 126'. Calipers 126' no longer contact a surface of lateral 106. The condition that calipers 126' no longer contact a surface of lateral 106 is sensed by position sensors 142 (FIG. 2) as the axial position of radially-inner end 134 corresponding to caliper 126' in a relaxed state is sensed. Caliper 126 extends only until it contacts the inner diameter surface of horizontal wellbore 102. In embodiments, tool 104 can include a centralizer 170

(FIG. 6). Centralizer 170 can concentrically position tool 104 at or near the axis of the wellbore in which it is located. In embodiments, the spring bias on each caliper 126 can be great enough that the calipers 126 urge tool 104 toward the axial center of the wellbore and, thus, function as a centralizer.

Figure 8:
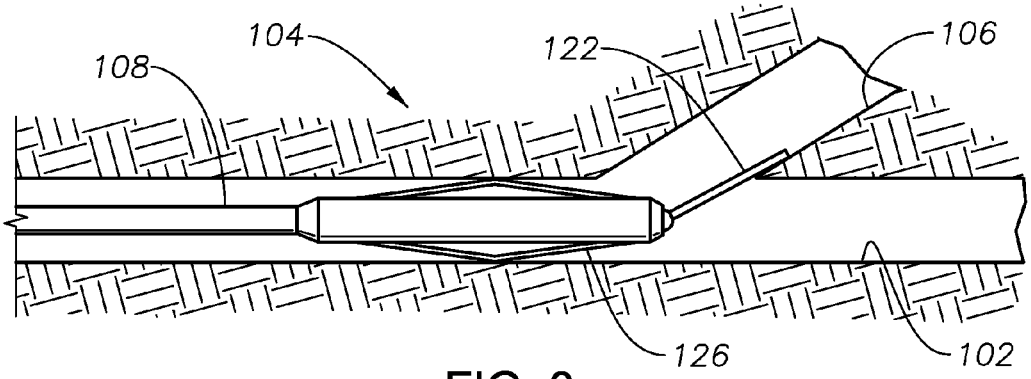
FIG. 8 is a sectional top view of the sensing tool of FIG. 1, showing the actuator arm positioned in the mouth of the lateral wellbore.

FIG. 8 shows how sensing tool 104 can be maneuvered into lateral 106. After detecting the location of lateral 106 from horizontal wellbore 102, sensing tool 104 is moved, by tubing 108, until the tip of steering arm 122 is axially adjacent to the opening of lateral 106. Tubing 108 can push or pull sensing tool 104, depending on whether sensing tool 104 is positioned before or after lateral 106, respectively. With the tip of steering arm 122 axially adjacent to the opening of lateral 106, steering arm 122 is positioned such that at least the tip of steering arm 122 enters lateral 106. In embodiments, steering arm 122 can be rotated toward lateral 106, and then angled until it enters lateral 106. Tubing 108 can then push sensing tool 104 further into the wellbore. As steering arm 122 contacts the inner diameter surface of lateral 106, it causes front end 118 of sensing tool 104 to move toward lateral 106. As sensing tool 104 is advanced further, sensing tool 104 enters lateral 106, and proceeds to move through lateral 106. Calipers 126 can then be used to sense the profile of lateral 106.

In embodiments wherein tool 110 includes a deviation survey sub, the deviation survey sub can be inserted into the lateral and provide the deviation angle of the lateral and the well with the vertical direction. The deviation angle and vertical direction can be used as a signature for the lateral. In embodiments, each lateral can have a deviation and vertical direction that is different from the deviation and vertical direction of any other lateral in the same well. Embodiments of a method for detecting lateral wellbores can include the steps of using tool 104 to determine the location of the lateral wellbore, using steering arm 122 to guide tool 104 into the lateral wellbore, and then using a survey sub to provide a deviation survey, the deviation survey then being used to confirm which lateral was entered by the BHA.

Figure 9A:
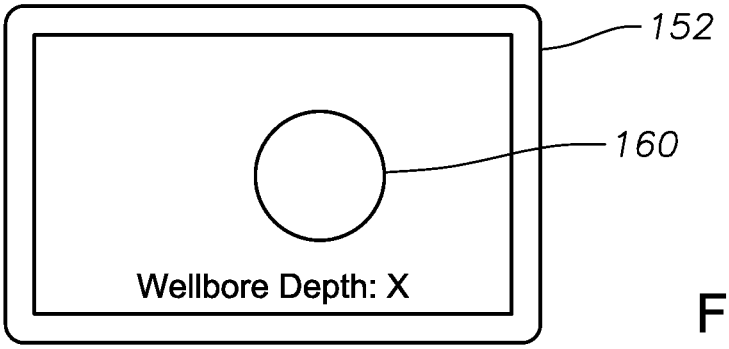
FIGS. 9A, 9B, and 9C are environmental views of an exemplary display of the data produced by the sensing tool of FIG. 1.
Figure 9B:
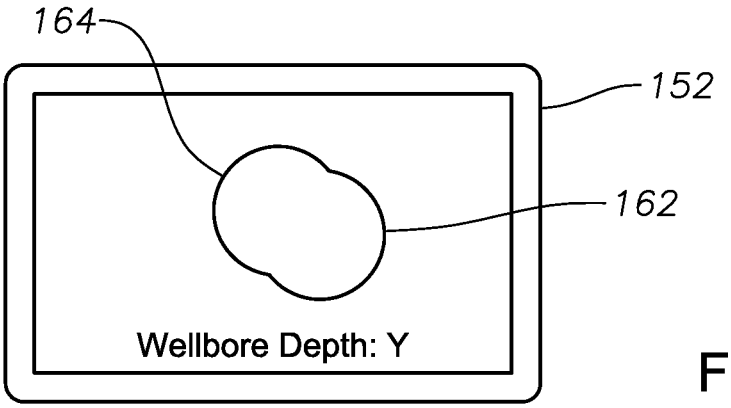
Figure 9C:
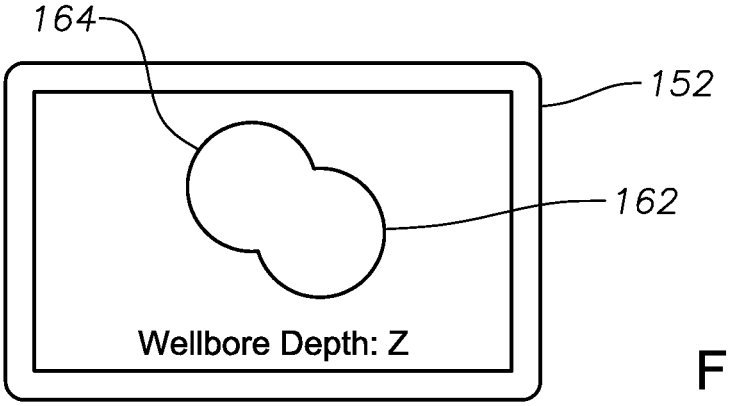

FIGS. 9A, 9B, and 9C show exemplary depictions of what an operator might see on display 152, as determined from the data from tool 104. The data indicates the relative position of the tip of each caliper 126, as determined by sensors 142 and processed by computer 150 (FIG. 2). The positions of the tip of each caliper 126 can be used to interpolate the wellbore profile at a given wellbore depth. Since tubing 108 extends from the tool 104 to the surface of the earth, by measuring or otherwise determining a length of tubing 108 that is inserted into wellbore 100, the precise depth of tool 104 is determinable. When the tool 104 is at a location where a lateral opening is detected, a distance from the surface of the earth to the lateral opening is determinable from the precise depth of the tool 104. FIG. 9A shows an exemplary wellbore profile determined from sensor 142 data, showing a generally cylindrical wellbore 160 at depth X, with no lateral wellbore intersection. FIG. 9B shows an exemplary wellbore profile determined from sensor 142 data, showing the intersection of horizontal wellbore 162 and lateral 164, the intersection being located at depth Y. FIG. 9C shows an exemplary wellbore profile determined from sensor 142 data, showing the intersection of horizontal wellbore 162 and lateral 164, after tool 104 is advanced further to depth Z, where Y>X and Z>Y. Note that the display shows the profile of the portion of lateral 106 in contact with calipers 126. The data from tool 104 can be used to create a profile log of the main bore and, by steering tool 104 into lateral 106, tool 104 can provide data to create a profile log of lateral 106. The profile log may contain data related to extension distance 140 for each of the plurality of calipers at each one of a plurality of incremental depths, for example. Furthermore, the precise depth, location, and direction of lateral 106 can be determined and included in a profile log.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within the said range.

Throughout this application, where patents or publications are referenced, the disclosures of these references in their entireties are intended to be incorporated by reference into this application, in order to more fully describe the state of the art to which the invention pertains, except when these reference contradict the statements made herein.

What is claimed is:

1. A method for detecting lateral bores from a main wellbore of a well and measuring a distance from the surface to the lateral bore, the method comprising:

(a) providing a caliper tool into the main wellbore, the caliper tool comprising a head having a first end, a steering arm, a second end, a plurality of calipers extending axially along a length of the caliper tool, the calipers each comprising a forward segment pivotingly attached to a body of the caliper tool, and a rearward segment pivotingly attached to an end of the forward segment that is distal from the body and having an end distal from the forward segment that slides axially along the body in response to radial movement of where the forward and rearward segments attach;

(b) moving the caliper tool axially through the main wellbore on a deployment member (c) monitoring axial movement of the end of the rearward segment that is distal from the forward segment to detect an inner diameter surface of the main wellbore;

(d) detecting a lateral bore branching off of the main wellbore by sensing that a one of the calipers is at a maximum radial extension;

(e) mapping a profile of an intersection between the main wellbore and the lateral bore, the profile reflecting a shape of outer circumferences of the main wellbore and the lateral bore over an axial distance traveled by the caliper tool;

(f) withdrawing the caliper tool upward such that the one of the caliper arms compresses inward from its maximum radial extension after detecting the lateral bore, and (g) lowering the caliper tool downward and into the lateral bore after the withdrawing.

2. The method according to claim 1, wherein each one of the plurality of calipers is operatively connected to a respective one of a plurality of measurement devices, and wherein the method further comprises the step of ascertaining the radial distance by which each one of the plurality of calipers extends from the head of the caliper tool with the plurality of measurement devices.

3. The method according to claim 2, wherein the step of ascertaining the radial distance by which each one of the plurality of calipers extends from the head of the caliper tool comprises detecting a configuration of a radially-inner end of the pair of segments with respect to the head of the caliper tool.

4. The method according to claim 3, wherein the plurality of measurement devices comprises a plurality of linear position sensors disposed axially along the head of the caliper tool such that each linear position sensor is operable to detect an axial position of at least one of the radially-inner ends of the pair of segments along the head of the caliper tool, and wherein the step of ascertaining the radial distance by which each one of the plurality of calipers extends from the head of the caliper tool comprises calculating the radial distance with the axial position detected by the respective linear position sensor.

5. The method according to claim 4, wherein the linear position sensors comprise linear variable displacement transducers that are disposed axially along the body, shuttles that are slideable adjacent each of the linear variable displacement transducers, springs biasing each of the shuttles in a direction towards the head, and pinned connections on surfaces of the shuttles facing away from the linear variable displacement transducers, and wherein the ends of the rearward segments that slide axially along the body each connect to the shuttles on the pinned connections.

6. The method according to claim 1, wherein each of the plurality of calipers is biased to a radially outward position, and wherein the step of detecting the lateral opening in the main wellbore comprises detecting a movement of at least one of the plurality of calipers from a radially inward position toward the radially outward position as the at least one of the plurality of calipers extends into the lateral opening.

7. The method according to claim 6, wherein the step of detecting the lateral opening in the main wellbore comprises detecting an initial contact of the at least one of the plurality of calipers that extends into the lateral opening with a surface of the lateral bore and subsequently detecting that the at least one of the plurality of calipers that extends into the lateral opening is free of contact with the surface of the lateral bore.

8. The method according to claim 7, further comprising the step of determining the direction of the lateral bore, relative to the main wellbore, based on the radial position of the at least one of the plurality calipers that extends into the lateral opening.

9. The method according to claim 1, further comprising the steps of advancing the caliper tool past the lateral opening and determining a profile of the lateral bore from movements of at least one of the plurality of calipers as the caliper tool advances past the lateral opening.

10. The method according to claim 1, wherein each of the plurality of calipers extends from the head a radial distance greater than a radius of the main wellbore when the calipers are in an unconstrained state.

11. The method according to claim 1, further comprising the step of creating a profile log of the main wellbore and the lateral bore.

12. The method according to claim 1, wherein the caliper tool further comprises a centralizer operable to maintain the caliper tool centered in the main wellbore, and wherein the step of detecting an inner diameter surface of the main wellbore comprises employing the centralizer to maintain the caliper tool centered in the wellbore so that each of the plurality of calipers extends radially from the head substantially no more than the rest of the plurality of calipers.

13. The method according to claim 1, wherein the caliper tool includes a steering arm connected to the second end of the head and selectively operable to be angled relative to head, and wherein the method further comprises the steps of positioning the caliper tool so that an end of the steering arm is located concentrically with the lateral opening and angling the steering arm in the direction of the lateral opening.

14. The method according to claim 13, further comprising the step of inserting the caliper tool into the lateral opening by axially advancing the deployment member through the main wellbore.

15. The method according to claim 1, wherein the caliper tool further comprises a magnetic sensor, and wherein the method further comprises the step of detecting, with the magnetic sensor, the presence of wellbore casing.

16. The method according to claim 15, further comprising the steps of advancing the deployment member through the main wellbore until the magnetic sensor is disposed axially beyond an end of the wellbore casing, detecting, with the magnetic sensor, the absence the wellbore casing, and determining the distance from the surface of the earth to the end of the wellbore casing.

17. The method according to claim 1, further comprising obtaining an angle of deviation of the lateral bore, and assigning a signature to the lateral bore based on the angle of deviation.

18. The method according to claim 17, further comprising detecting additional lateral bores that branch from the main wellbore, obtaining an angle of deviation of each of the additional lateral bores, compiling the angle of deviation of the lateral bore and the angle of deviation of each of the additional lateral bores to form a deviation survey, identifying a specific one of the lateral bores based on the deviation survey.

19. A method for detecting lateral bores from a main wellbore of a well and measuring a distance from the surface to the lateral bore, the method comprising:

a. providing a caliper tool into the main wellbore, the caliper tool comprising a head having a first end, a second end, calipers comprising elongate forward and rearward segments each having ends pivotingly connected to one another and opposing ends coupled to a body of the caliper tool, linear variable displacement transducers disposed axially along the body, and shuttles that each pivotingly connect to opposing ends of the rearward segments and that are slideable adjacent each of the linear variable displacement transducers;

b. moving the caliper tool axially through the main wellbore on a deployment member that connects to the first end of the head, so that where the forward and rearward segments attach is radially displaced in response to contact with a sidewall of the main wellbore and with contact with a sidewall of the lateral bore;

c. detecting an inner diameter surface of the main wellbore by monitoring axial movement of the shuttles with the linear variable displacement transducers;

d. using the calipers to detect a lateral bore branching off of the main wellbore; and e. determining the distance from the surface of the earth to the lateral opening, wherein the caliper tool further comprises springs biasing each of the shuttles in a direction towards the head, and pinned connections on surfaces of the shuttles facing away from the linear variable displacement transducers, and wherein the ends of the rearward segments that slide axially along the body each connect to the shuttles on the pinned connections.

* * * * *